US006032427A

United States Patent [19]

Randjelovic

[11] Patent Number: 6,032,427

[45] Date of Patent: Mar. 7, 2000

[54] PORTABLE PANEL SPORTS FLOOR SYSTEM

[75] Inventor: Erlin Randjelovic, Crystal Falls, Mich.

[73] Assignee: Connor Sports Flooring Corporation, Norcross, Ga.

[21] Appl. No.: 08/767,261

[22] Filed: Dec. 13, 1996

[51] Int. Cl.[7] ..... E04B 5/00

[52] U.S. Cl. ..... 52/584.1; 52/582.1; 52/480; 52/403.1

[58] Field of Search ..... 52/480, 220.8, 52/220.1, 220.2, 582.2, 587.1, 586.1, 589.1, 586.2, 127.5, 127.6, 127.9, 591.5, 592.1, 223.11, 584.1, 223.7, 391, 403.1; 403/337, 335, 405.1, 408.1, 348, 321, 322.1, 386

[56] References Cited

U.S. PATENT DOCUMENTS 2,466,613 4/1949 Richardson ..... 52/223.7
3,141,392 7/1964 Schneider et al. .
3,967,428 7/1976 Pierce et al. ..... 52/582.2
5,303,526 4/1994 Niese ..... 52/480 X
5,603,134 2/1997 Whipkey et al. ..... 52/223.7 X

*Primary Examiner*—Robert Canfield
*Attorney, Agent, or Firm*—Mark R. Galis; Michael Camillo

[57] ABSTRACT

A resilient portable sports floor system, more particularly one which is formed of a plurality of components which may be easily interconnected to form an integrated sports surface. The floor system includes a plurality of floor panels, each floor panel including a playing surface and four sides, at least one floor panel attachment mechanisms on each side of the floor panel, and a drive mechanism attached to each of said floor panels and attached to a floor panel attachment mechanism, the drive mechanism including a threaded rod. When the threaded rod is rotated it moves the drive mechanism with respect to the floor panel.

10 Claims, 11 Drawing Sheets

PORTABLE PANEL SPORTS FLOOR SYSTEM

TECHNICAL FIELD

This invention relates to a portable sports floor system, more particularly one which is formed of a plurality of components which may be easily interconnected to form an integrated sports surface.

BACKGROUND OF THE INVENTION

Portable panel sports floor systems are typically comprised of individual panels which when positioned correctly and attached to adjacent panels, form a sports surface for activities such as basketball, volleyball, aerobics and dance. The typical mechanism for one panel to attach to the adjacent panel varies and includes such means as countersunk machine screws in the surface of the panels, subfloor locking pins and latches, as well as machine screws placed in strategically placed subfloor brackets.

A portable sectional flooring systems such as U.S. Pat. No. 3,141,392 to Schneider which depicts individual panels which form an integrated floor when connected. Panel to panel connection is achieved by manually angling, aligning, and forcing panels into connecting positions. Disconnecting panels requires manual lifting and angling for panels to swing out of alignment.

Another portable panel connecting design is described in U.S. Pat. No. 5,070,662 to Niese. The Niese patent incorporates set screws which are exposed at the perimeter surface of the panels. The panels must be aligned and forced into position prior to engaging the set screws which bind adjacent panels together. A system such as U.S. Pat. No. 3,967,428 to Niese typifies the basic design of common portable sports floors currently in use.

The Niese design and other portable panel systems commonly used today are comprised of individual panels set in a staggered pattern to provide offset integration. Common panels typically provide a sports surface such as hardwood flooring which is attached by means of mechanical fasteners, normally flooring staples or cleats, to the subfloor. The subfloor often includes plywood sheeting as an upper subfloor surface which is mechanically attached to a lower series of sleepers such as softwood runners.

Resiliency typically provided in hardwood sports floor systems incorporate individual pads manufactured in a variety of elastomeric materials. Resilient pads are of different shapes and sizes and is commonly manufactured through molding or extrusion. Examples of pads currently in use below sports floor systems are described in patents such as U.S. Pat. No. 4,879,857 to Peterson, U.S. Pat. No. 4,890,434 to Niese, and U.S. Pat. No. 5,369,710 to Randjelovic.

There are many other types of resilient pads currently in use, and these are commonly attached to the underside of the hardwood subfloor system Inclusion of resilient pads in portable floor systems require additional precautions in regards to the effects of panel movement during assembly and disassembly. U.S. Pat. No. 5,303,526 to Niese, as well as U.S. Pat. No. 4,860,516 to Koller, describe a design which provides resilient pads incorporated in portable floor systems.

It is the object of the invention to provide a substantially improved method for assembly and disassembly of panels which comprise a portable sports floor system. An object of the invention includes a more efficient apparatus and manner of installation which significantly reduces labor necessary during assembly and is more efficient during disassembly, also significantly reducing labor.

Another object of this invention includes a manner of assembly and disassembly which significantly improves the handling and reduces wear to the flooring panels.

It is further an object of the invention to provide a sports system including a manner of integrated resiliency. This object of the invention includes designs to protect resilient material incorporated into the portable panels from negative effects associated with assembly, use, disassembly, and storage.

It is known that portable panels require placement and alignment prior to connecting to adjacent panels. As described in the Niese patent, installers must hit the side of the floor section with a large rubber mallet to move them into proper position. The procedure of striking the side edges of the panels to provide alignment is detrimental to the integrity of the floor system and causes unwanted wear to the panels.

The description of the invention which follows illustrates a design which mechanically aligns portable panels without the use of mallets or other non preferred force. This procedure eliminates the wear and labor required to forcefully align each panel. The invention provides mechanical alignment while at the same time providing connection to adjacent panels.

Current designs which require force during placement also require force during removal. The description of the invention shall illustrate a manner of mechanically disassembling portable panels. This process is a time saving method and eliminates the necessity of mallets or pry bars for removal of panels prior to transfer and storage.

Portable panels require correct alignment along the opposing side and end of adjacent panels. The placement of known system panels requires maneuvering in two directions. The invention incorporates a design which introduces concurrent movement to both the side edge and end edge during the mechanical installation process.

Also, the mechanical installation process can be performed from an end edge that does not abut an adjustemnt panel therby eliminating installation problems associated with access to the abutting ends.

To achieve the preferred attachment of portable panels the invention provides a concealed mechanical drive design which when activated draws adjacent panels tightly together at the side joints.

The invention further provides a means to mechanically push panels apart at side joints again by activating the concealed drive design.

The preferred method of the invention provides panel-to-panel end attachments which also draw the panels together as the concealed mechanical drive mechanism is activated The invention provides release of the end attachment by again activating the concealed mechanical drive.

Since the invention preferably incorporates elastomeric material in the form of resilient pads, it is important that adjacent panels deflect in unison to prevent vertical ridges from occurring in the floor's surface during sports activities. The mating of the side and end edges during panel-to-panel connection requires particularly tight integration to form a singular reaction to active loads. As the panel side and end mating tolerance must be minimal to accomplish the preferred interaction it increases the invention's effectiveness of drawing together and interlocking panels through mechanical means rather than manual force. The latter of which can negatively influence the tolerance required to assure that adjacent panels move in unison when one or the other panel is deflected.

Resilient panel systems requiring such tight interlocking tolerance to provide preferred and even deflection at panel joints are more difficult to disassemble. The invention provides a mechanical method to disassemble panels, again without the manual force associated with current resilient portable panel design.

The first preferred method of portable panel construction consists of an upper layer of flooring such as tongue and groove random length hard maple, although any practical wood specie is an acceptable floor surface. The flooring surface may also include square edge wooden planks or a synthetic surface.

The sports surface is preferably attached to an upper subfloor of plywood or composite board sheeting. The most preferred attachment of the surface flooring is by means of flooring cleats or staples, although the surface flooring such as square edge wooden planks and synthetic material would preferably be attached by an adhesive layer.

The preferred method of the invention includes attachment of the upper subfloor to lower subfloor supports of nominal two inch by three inch softwood runners. While the most preferred method of attaching the upper subfloor sheeting to the softwood runners is by means of staples, adhesive may also be provided between the upper and lower subfloor panels.

The first preferred method of the invention includes isolated resilient pads attached to the underside of the softwood runners. The resilient pads may be of any type of elastomeric material and provided in a wide variety of shapes. The resilient pads are preferred to be attached by means of staples or adhesive.

It is further preferred to provide a partial encasement of the softwood runners to protect the resilient pads. The partial encasement is designed in a manner to provide a full rigid surface for support between the portable panels and substrate, and to allow wanted deflection of the floor system when impacted by athletic loads. Unlike the Niese and Kohler designs resiliency can be added to the floor system at a later date should the owner decide to initially purchase a standard non padded system. This feature is provided by attachment of resilient pads and extruded encasement later described through drawing details.

The standard portable panel of the first preferred construction is normally four feet by eight feet in size, although nominal four feet by four feet panels are also required to start alternating panel rows, thereby creating a staggered pattern of panels in the floor system. The eight foot edge of a standard panel is referred to as the side edge and includes a synthetic tongue or groove encasement on the edge of the upper subfloor sheeting. The tongue and groove which oppose each other on adjacent panels are drawn tightly together by mechanical assembly. The playing surface or top surface extends over the tongue and groove located below, thereby concealing the pieces when the floor system is in use.

The four foot edge of a standard panel is referred to as the end edge, and includes either male or female interlocking attachments connected to the lower subfloor runners. The female attachments are slightly angled to accept the male flange attachments as the panel side edges are drawn together. This design allows the panel to be drawn tightly in two directions simultaneously thereby providing both side edge and end edge integration. The playing surface also extends beyond the end edge connectors also concealing them from view when the floor system is in use.

The first preferred embodiment of the invention includes a driving mechanism located in slots of particularly located runners. The driving mechanism is constructed in a manner to activate a latching device forward or backward by means of a standard power tool, either electric, manual or battery powered. The latching device in the first preferred method is a simple hook extending from the drive mechanism. The hook is easily latched to opposing plates strategically located in adjacent panel side edges. The hook is attached to the driving mechanism in a manner which maintains its position without revolving as the drive mechanism is engaged and turning. This design allows adjacent panels to be drawn together or separated mechanically as preferred. These descriptions and other teachings of the invention will be further illustrated in the drawings.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
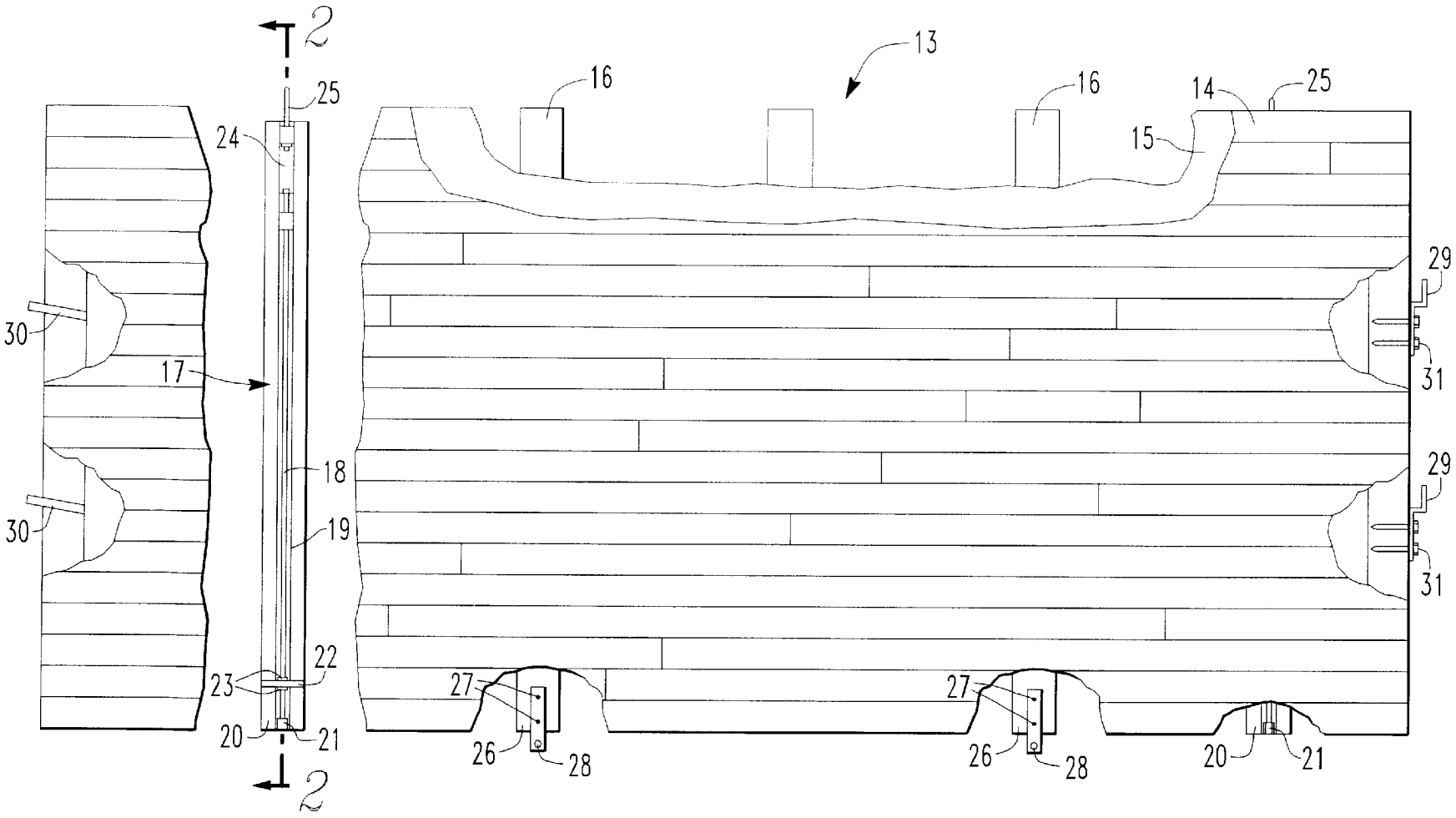
FIG. 1 is a top view of a full portable panel including exposed views of panel-to-panel attachment connectors and an exposed view of a panel attachment drive mechanism.

FIG. 1 is a top view representing a portable panel 13 incorporating a flooring or top surface 14 of random length hardwood strips. The upper subfloor 15 is provided in plywood sheeting attached to the lower subfloor surface 16 typically constructed of softwood runners.

The preferred embodiment of the invention includes a drive mechanism 17 featuring a threaded rod 18 and related driving rod attachments which align in a grooved slot 19 provided in one or more of the lower softwood runners 20. The softwood runners 20 are one way to encase the drive mechanism 17, which may alternatively be encased a number of different ways, such as in a separate encasement attached to the underside of the upper subfloor 15. The encasement may be manufactured of metal, plastic or other suitable material.

Threaded rod 18, the driving force, is activated by a battery powered or electric drill attached via a socket to the hex head 21 of the threaded rod 18. The hex head 21 is only one of numerous ways to provide an attachment or engagement mechanism for the threaded rod 18, but may also be, by way of example, an allen wrench head, a T head or others which can be mechanically attached to.

Threaded rod 18 may be threaded in a variety of different ways, such as at both ends instead of throughout its entire length, or only threaded at the end where the traveling mechanism is located, with drive ends having stops on both sides of the limiting plate 22, or it may have limiting plate 22 adjacent to hex head 21 and only one pair of locking nuts 23 on the back side of limiting plate 22.

The role of the limiting plate 22 may also be filled by providing other stationary material intersected by the threaded rod 18, such as hard blocks affixed in the grooved slot 19 and intersected by the threaded rod 18. The limiting plate 22 may also included attachments such as U shaped brackets or other shapes which insert at the end of the runner 20.

The locking nuts 23 are one of the ways the invention can be accomplished in the preferred embodiment, but could for instance be replaced by other limiting attachments such as pins which penetrate the threaded rod 18 and protrude adjacent to the limiting plate 22, or by welded stops on each side of the limiting plate 22.

Included in the drive mechanism 17 is a limiting plate 22 which is countersunk into a right angle slot provided in softwood runner 20. The limiting plate 22 is intersected by the driving rod 18 to pass freely through the limiting plate 22. Locking nuts 23 are attached to the driving rod 18 on opposing sides of the limiting plate 22. The trailing end of the threaded threaded rod 18 intersects threaded holes in the lead end of a traveling mechanism 24. The trailing end of the traveling mechanism 24 provides attachment for a male connector 25 which extends from the side edge of the panel 13 when the traveling mechanism 24 is forwarded. When the traveling mechanism 24 is reversed, the male connector 25 aligns below the side edge of the panel 13.

The traveling mechanism 24 may be provided in one of a number of different ways, such as in the form of a solid steel plate with an attached coupling which is intersected by the threaded rod 18. The steel plate may be manufactured in a design which provides a notch in the protruding end to hook to the female side connector 26. The traveling mechanism 24 may also be provided in a design with two threaded ends such as a turn buckle allowing the threaded rod 18 to move through the lead end and a stationary threaded male connector 25 to be permanently attached to the trailing end for attachment to the female side connector 26.

The traveling mechanism 24 may still further be provided in a design which includes an elongated bracket with a threaded nut attached at the lead end which is intersected by the threaded rod 18. The trail end of the elongated bracket may have a cross member such as a machine screw or other attachment which forms a female hook for attachment to a male connector on an opposing panel. The traveling mechanism 24 may be provided in many different materials such as hard plastic, aluminum or other moldable product, or cast iron which is manufactured with a threaded section and hooking section.

The side panel male connection 25 may be provided in a number of alternative ways, such as in the form of a hooking design specifically manufactured into the traveling mechanism 24 by creating a bend or a notch to create a male hook for the opposing female connector 26. The side panel male connector 29; may also be provided in the form of a female connector which would connect to an opposing male connector on the adjacent panel, or in the form of a downward angle which overlaps an upward angle on the adjacent panel.

The side panel female connectors 26 may likewise be provided in one of a number of different ways, an alternative of which may be provided in the form of extruding softwood runners 20 with holes provided in the surface for attachment by hooking mechanisms of adjacent panels, or in the form of extending brackets mounted to the softwood runners 20 to provide a hooking location for the adjacent panels. The side panel female connectors 26 may also be provided by attaching them strategically to other components of the panel such as the underside of a plywood subfloor to provide a stationary attachment for adjacent panels, or in a design including a flange which is set vertically and perpendicular into the softwood runner.

The exposed views of the panel 13 in FIG. 1 includes side and end connectors for interlocking panels. As detailed in FIG. 1, the lower side edge provides two female connectors 26, each one secured into the lead end of particular softwood runners 16 by means of wood screws 27. The female side connectors 26 are preferably manufactured of ⅛" steel plate and each provides an anchoring hole 28. The anchoring holes 28 may also be provided in the female connectors in any shape which allows the adjacent panels connector to hook as desired.

The end edges of the panel 13 provide panel end edge male connectors 29 and panel end edge female connectors 30. The male connectors 29 are properly located and attached to the side edge of the right outermost softwood runner 16 by means of wood lag bolts 31. The panel end edge male connector 29 is preferably manufactured of ⅛" steel plate. The panel end edge male connector 29 may also be provided as a flat plate and spacer attached to the softwood runner 16, the flat plate being manufactured to extend beyond the spacer, allowing it to hook into the opposing panel end edge female connector 30.

The panel end edge male connector may also be provided as an extending pin protruding from a steel plate connected to the softwood runner 16. The pin which is preferably tapered penetrates the adjacent connector on the opposing panel. The adjacent female connector to the pin would be provided as a steel plate with an anchoring hole positioned perpendicular to the pin.

The panel end edge male connector may be manufactured out of many different materials, examples of which are hard plastic, aluminum, moldable material or of cast iron, to provide a panel end edge connector 29 which secures into the opposing panels end edge connector as the panels are drawn together during assembly.

The panel end edge female connectors may likewise be manufactured out of many different materials, examples of which are hard plastic, aluminum, moldable material or of cast iron. The connector provides a tapered fit for the preferred connection to the adjacent panels opposing connectors as the panels are drawn together. The manufacture of components in this manner may include anchorage holes for attachment of connectors to softwood runners 16.

Figure 2:
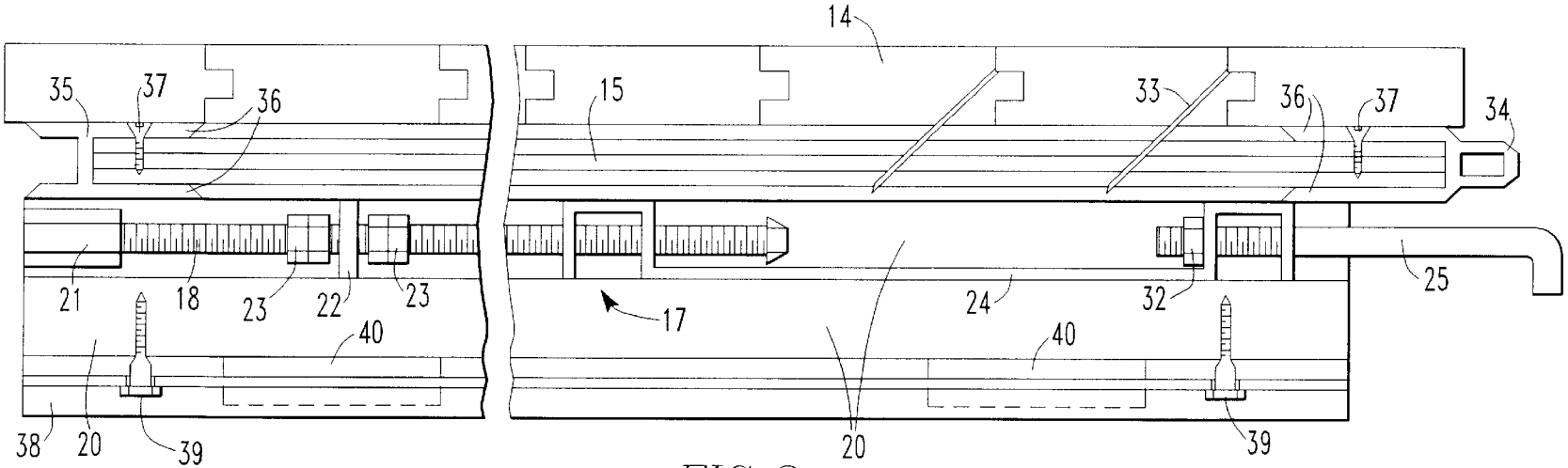
FIG. 2 is a side view of a drive mechanism and associated construction taken along lines 2—2 of FIG. 1.

FIG. 2 shows a side view of the drive mechanism 17. The threaded driving rod 18 is shown with the hex head 21 available for connection by a socket which is driven by a battery or electric drill. Two sets of locking nuts 23 are shown on opposing sides of the limiting plate 22 which is fitted into a slot provided perpendicular to the softwood runner 20. As shown, the locking nuts 23, are set back slightly on each side of the limiting plate 22. The limiting plate 22 provides an oversized passage hold for the threaded rod 18 thereby restricting shifting of the threaded rod 18 forward or backward when the hex head 21 is engaged.

The preferred design of the traveling mechanism 24 is detailed including two threaded penetration areas which are intersected by the threaded rod 18. As the hex head 21 is engaged and the threaded rod 18 revolves, the traveling mechanism 24 either moves forward or backward, depending on whether the hex head 21 is turned clockwise or counterclockwise. The traveling mechanism 24 also provides two penetration areas for the male connector 25 which is held stationary by a holding nut 32 located at the open penetration point of the traveling mechanism 24.

Other elements of the preferred portable panel design are shown in FIG. 2. The flooring or top surface 14 of random length hardwood strips are shown attached by means of flooring fasteners 33 to the upper subfloor surface 15 which is preferably plywood sheeting attached to the lower softwood runner 20. The softwood runner 20 is provided in a dimension which is shorter at the male connector 25 end than the upper subfloor surface 15 and flooring surface 14 above. This allows the male connector 25 to align fully below the upper subfloor surface 15 when the traveling mechanism 24 is reversed.

Also, shown in FIG. 2 is the panel side edge tongue 34 arrangement and panel side edge groove 35 arrangement. The preferred material of the tongue 34 and groove 35 is an extruded material such as hard plastic or aluminum. Both the tongue 34 and groove 35 provide a C shaped design to capture the side edges of the upper subfloor panel 15. The edges of subfloor panel 15 are machined to allow the flanges 36 of the tongue 34 and groove 35 to fit flush to the top and bottom of the upper subfloor 15. The flanges 36 are preferred to be glued to the upper subfloor 15 and flush countersunk screws 37 are also provided.

Additionally FIG. 2 shows a cut away side view of the resilient pad encasement 38. This is provided preferably in an extruded plastic or aluminum offering a channel on the underside of the pad encasement 38. The channel provides clearance for the head of the anchor bolts 39 as the portable panel is deflected under athletic loads. An exposed view of the pad encasement 38 illustrates positioning of resilient pads 40 which support the underside of the softwood runner 20.

The tongue and groove along the side edge of the panels may be provided in other manners, including a design incorporating a single flange extending from the back side of the tongue 34 and groove 35. The single flange may be inserted and anchored into a horizontal slot provided in the face of the side edge of the upper subfloor 15. The provisions along the side edge may be provided by manufacturing a shoulder into the side edge of the upper subfloor 15 to accommodate a tongue 34 and groove 35 arrangement which does not include a flange or flanges. The tongue 34 and groove 35 may be set into and attached to the shoulder of the upper subfloor 15.

The resilient pad encasement 38 may be provided in the form of a U shaped channel which partially encases the softwood runners. The side walls are provided in a vertical dimension greater than the thickness of the resilient pads 40 with adequate extension along side edges of the softwood runners. The extended walls of the U channel allow oblong slots on FIG. 2 to be placed in preferred locations adjacent to the side edges of the softwood runners. The oblong slots are penetrated by means of anchors which are screwed into the side walls of the softwood runners. As the floor is impacted the oblong slots allow the sleeper to deflect into the U channel without interference by the anchors.

Figure 3:
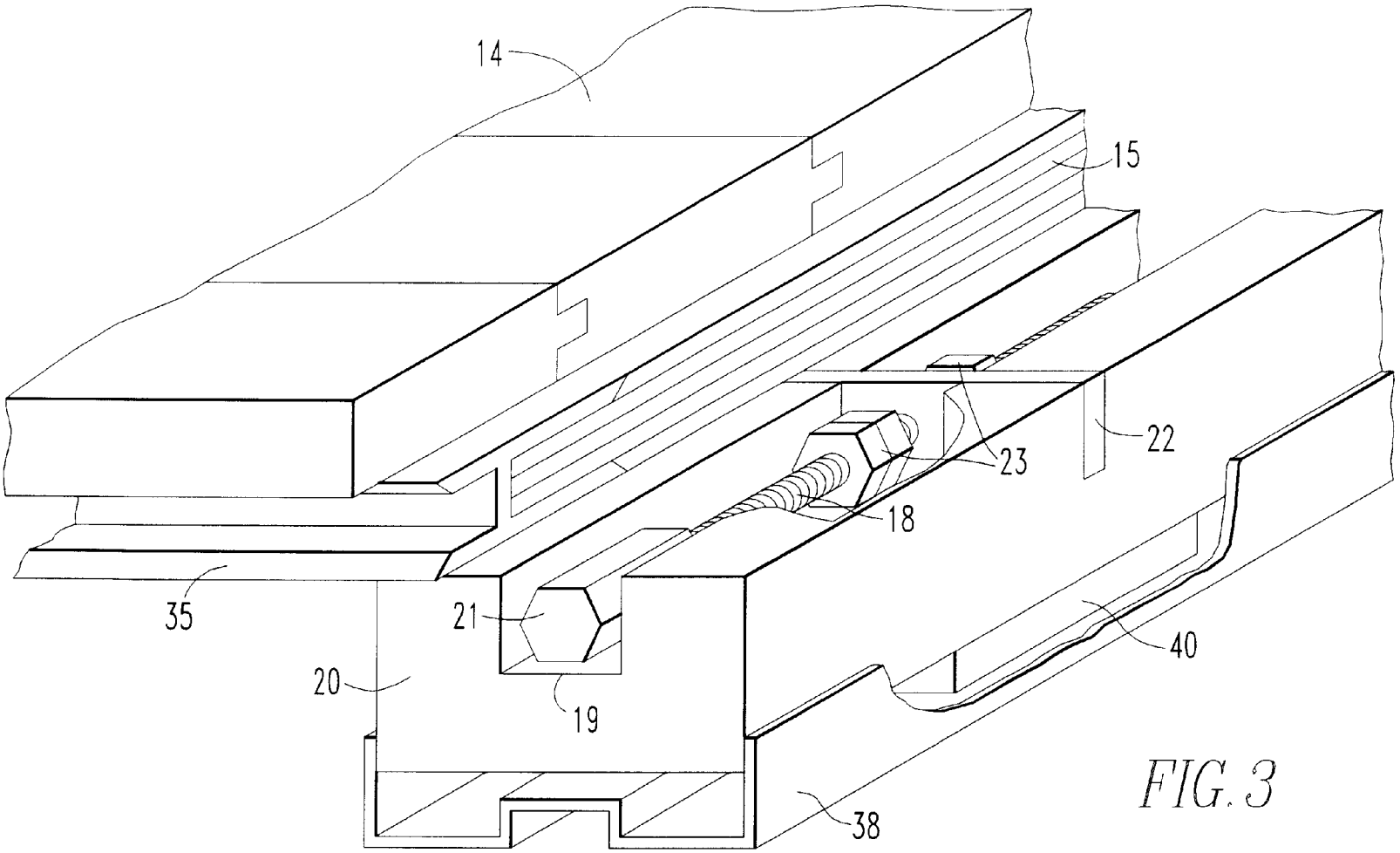
FIG. 3 is a perspective view of the power tool drive head as referenced in FIG. 1.

FIG. 3 is a perspective view of the hex head 21 attached to the threaded rod 18 which passes through the limiting plate 22. Also shown are the locking nuts 23 attached to the threaded rod 18, in close proximity to each side of the limiting plate 22. The grooved slot 19 is also illustrated as provided in the softwood runner 20. Other construction as previously described includes the flooring surface 14, the upper subfloor 15, and the side edge groove 35. Also, a perspective view of the resilient pad encasement 38 and resilient pad 40 is included. As shown, the grooved slot 19 in the softwood runner 20 provides clearance for a drive socket to be attached to the hex head 21.

Figure 4:
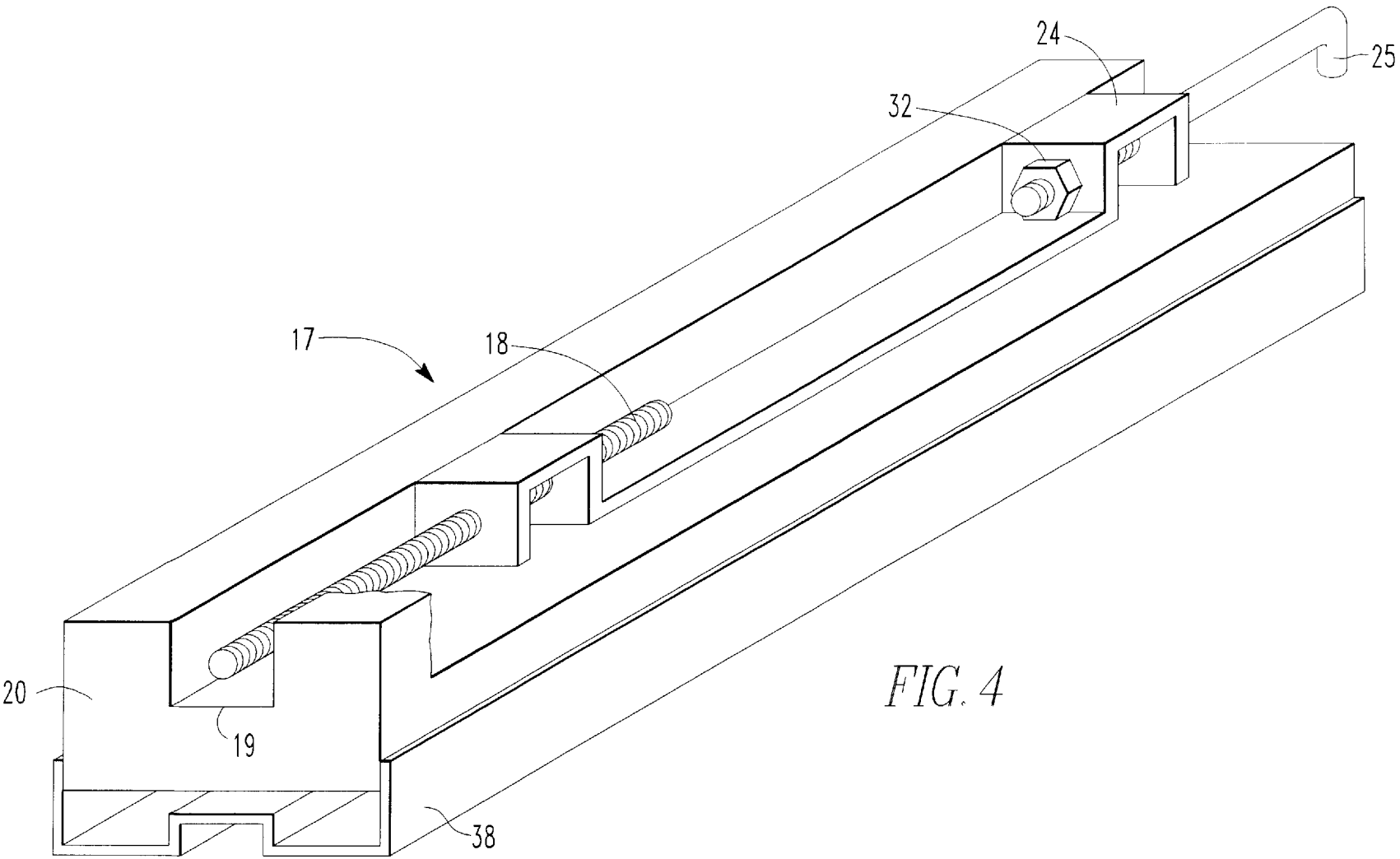
FIG. 4 is a perspective view of the male connecting end of the drive mechanism as referenced in FIG. 1.

FIG. 4 is a perspective view of the male connector 25 which is attached to the traveling mechanism 24 and held into position with the holding nut 32. Also illustrated is the threaded rod 18 which intersects the traveling mechanism 24. The softwood runner 20 is shown including the grooved slot 19 which provides clearance and conceals the drive mechanism 17 and maintains the traveling mechanism 24 in the proper alignment. The resilient pad encasement 38 is also shown in this perspective view.

Figure 5:
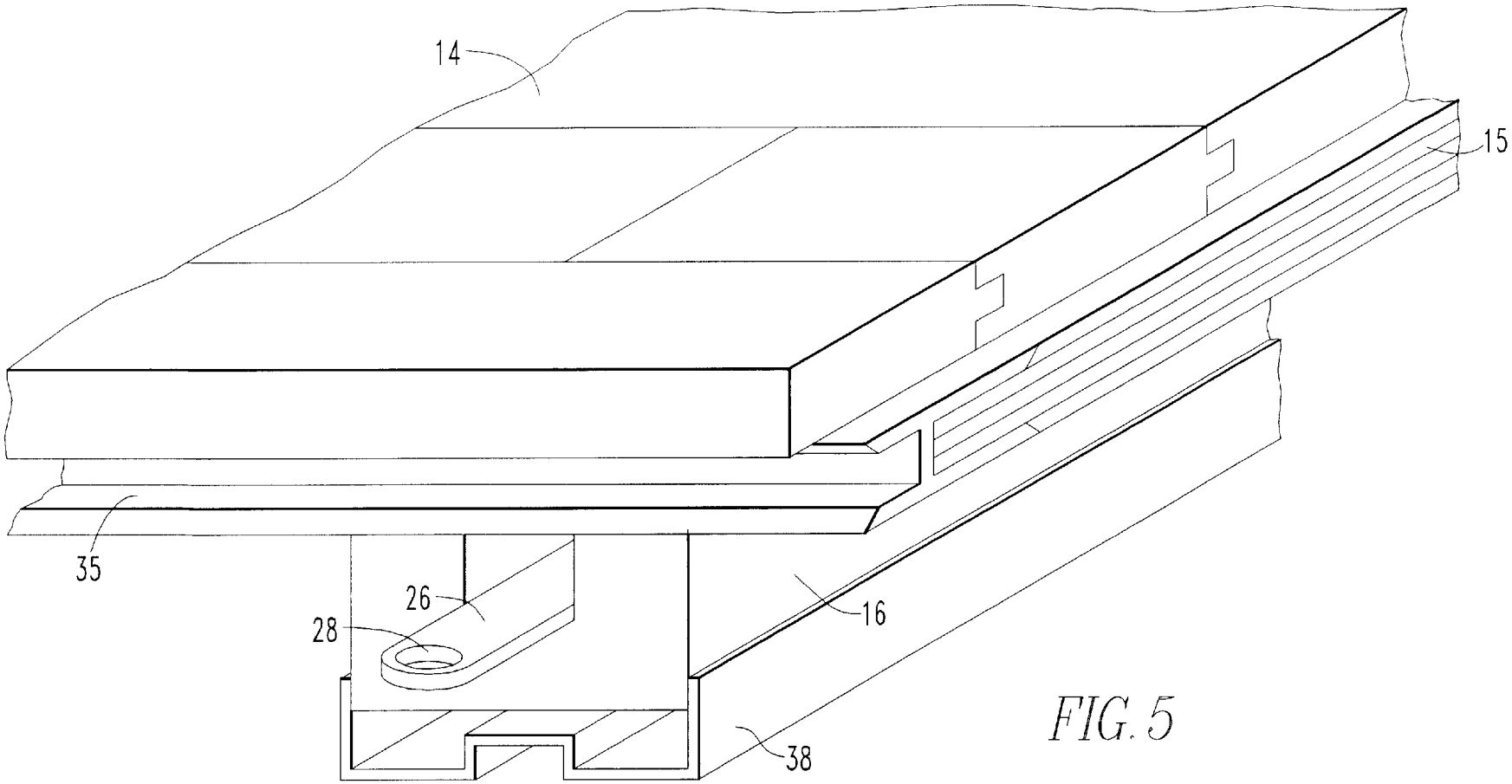
FIG. 5 is a perspective view of a panel side edge female connector as referenced in FIG. 1.

FIG. 5 shows a view of the panel side edge female connector 26 including the provision of the anchoring hole 28. Also included is a view of the panel side edge groove 35 which is attached to the upper subfloor 15 which provides support and attachment to the flooring or top surface 14. The panel side edge female connector 26 is fitted into a slot provided in the softwood runner 16 and attached by means of wood lag bolts. A view of the resilient pad encasement 38 is also included in this view as positioned below the softwood runner 16.

Figure 6:
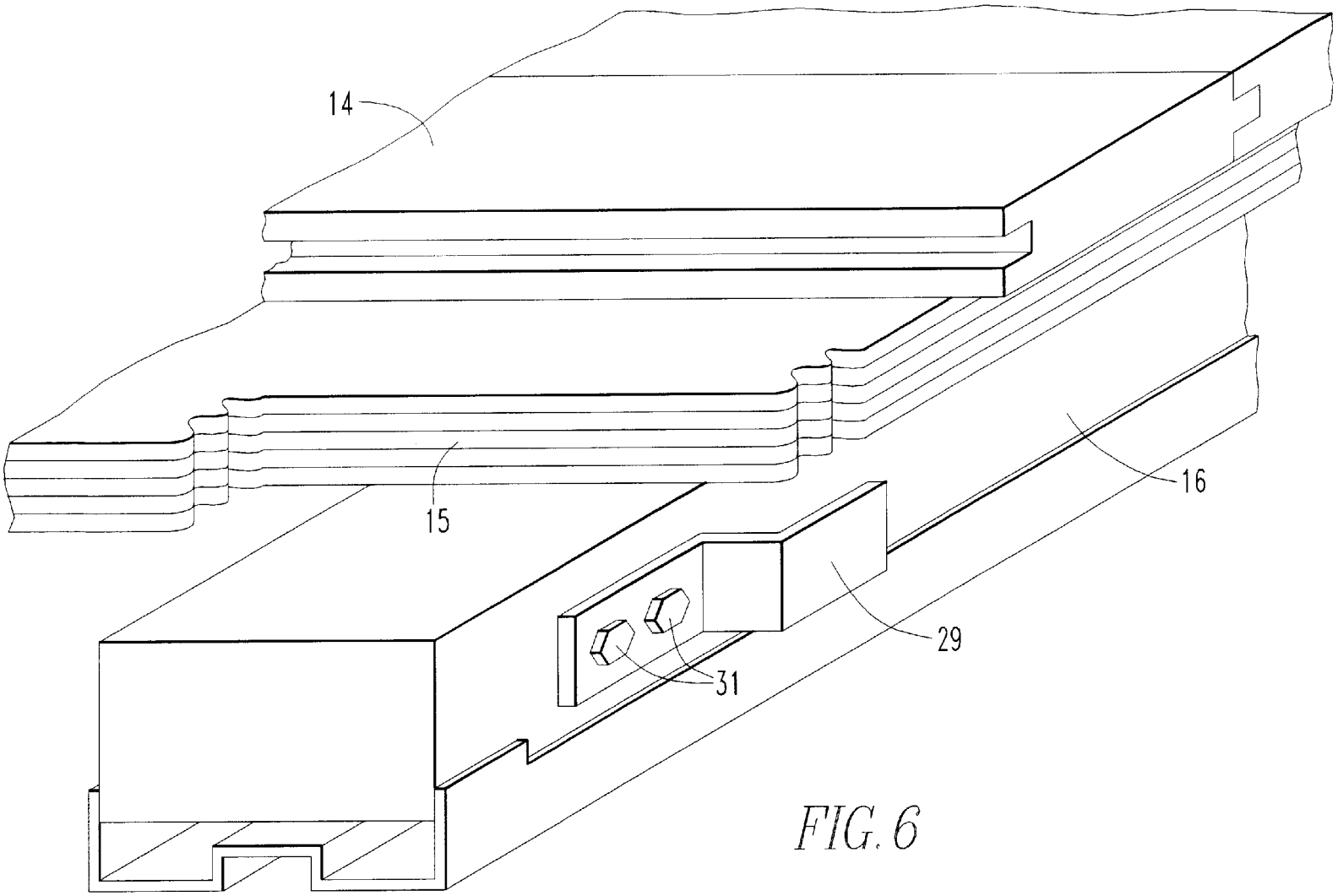
FIG. 6 is a perspective view of a panel end edge male connector as referenced in FIG. 1.

FIG. 6 details the panel end edge male connector 29 which is attached to the outermost right softwood runner 16 of the panel by means of wood lag bolts 31. The male connector 29 provides a slight taper at the lead end to assure alignment into the panel end edge female connector as described in FIG. 7. The view also shows the preferred attachment of the upper subfloor 15 and flooring surface 14 which aligns beyond the male connector 29 for protection during moving and storage.

Figure 7:
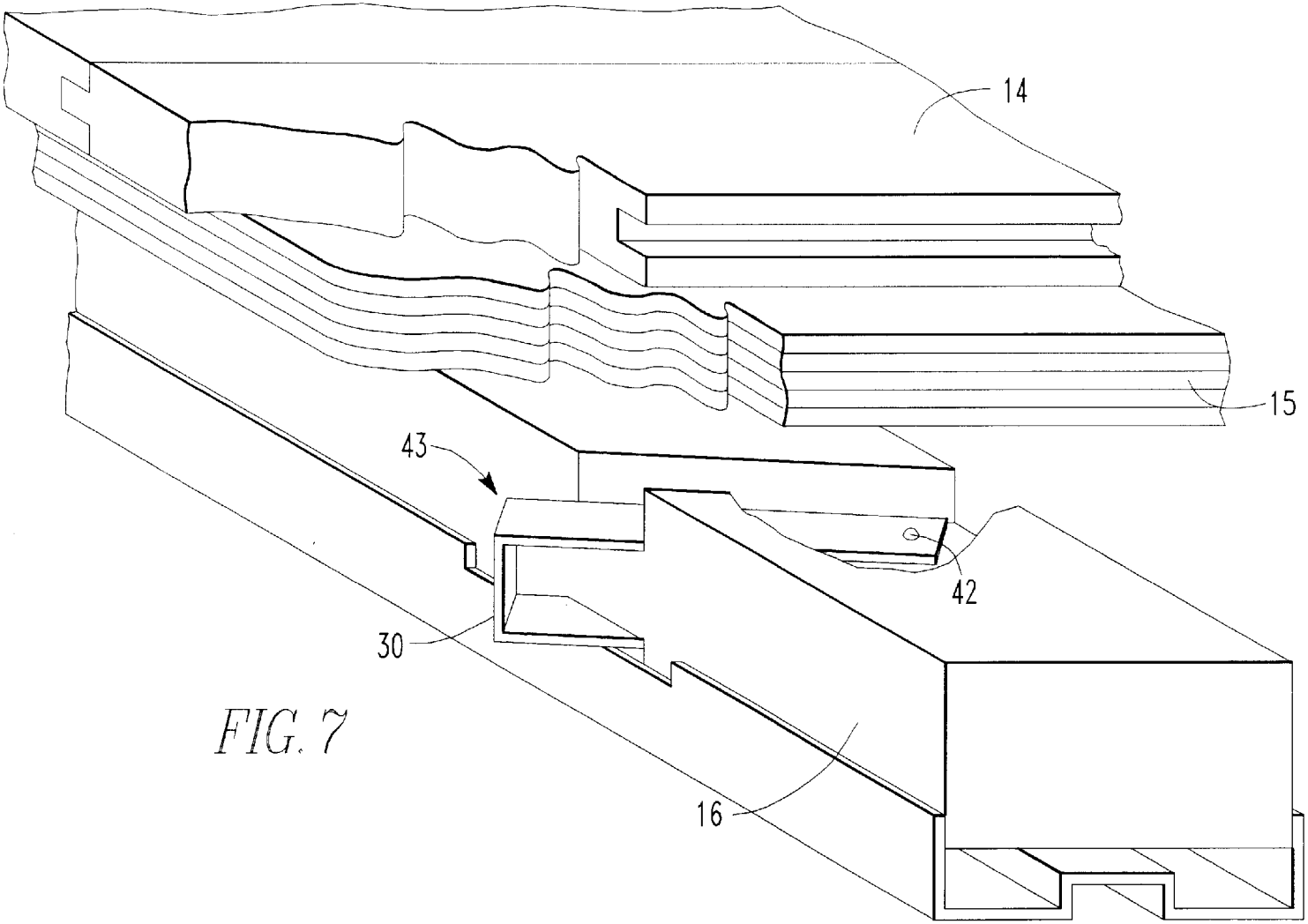
FIG. 7 is a perspective view of a panel side edge female connector as referenced in FIG. 1.

FIG. 7 details the panel end edge female connector 30 which is connected to the outermost left softwood runner 16 of the panel by means of wood lag bolts 42. The connector 30 is preferably manufactured as a steel bracket providing an upper and a lower flange positioned in an upper and lower slot 43 provided in the runner 16. The inner vertical clearance of the connector 30 is provided in the same overall vertical dimension of the panel end edge male connector previously described in FIG. 6. The upper and lower slots 43 are provided at a preferred angle to the softwood runner 16 to influence the adjacent panel into a tight alignment during connection. The flooring surface 14 and upper subfloor 15 are detailed in the preferred manner in relationship to the connector 30 and softwood runner 16 allowing clearance to the end edge male connector of the adjacent panel.

Figure 8:
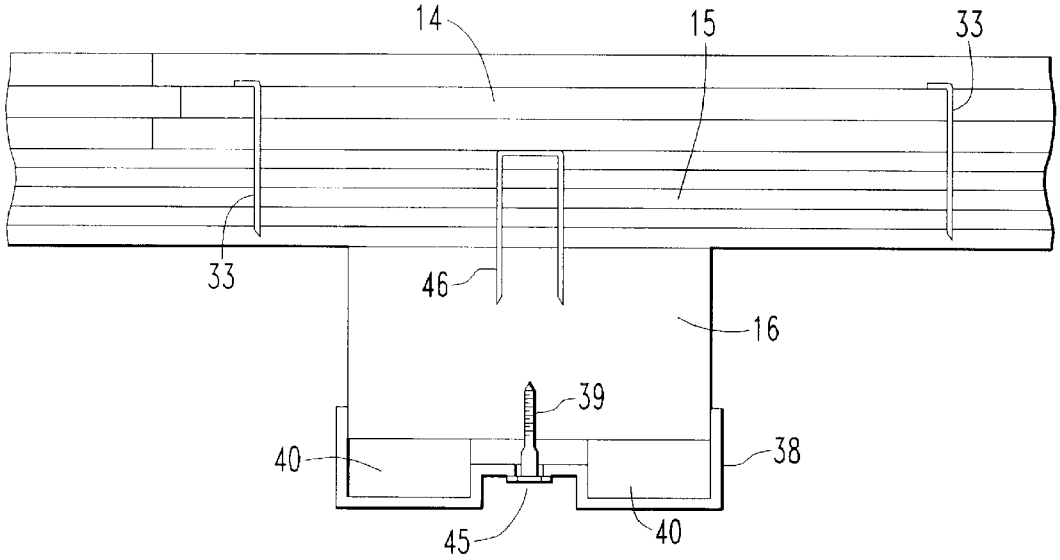
FIG. 8 is an end view of resilient pads and resilient pad encasement.

FIG. 8 is an end view of the resilient pad encasement 38 which is affixed to a softwood runner 16 by means of a wood lag bolt 39. Individual resilient pads 40 are attached to the encasement 38 preferably by means of adhesive. A channel 45 is provided in the underside of the encasement 38 to allow clearance between the head of the wood lag bolt 39 and the substrate. The penetration area provided in the encasement 38 is oversized to the wood lag bolt 39 to allow vertical movement of the softwood runner 16 while the resilient pad encasement 38 remains stationary. Flange areas along each side of the encasement 38 align slightly higher than the lower edge of the softwood runner 16. This maintains the alignment of the encasement 38 in the proper position especially during assembly and disassembly of portable panels. FIG. 8 also details the flooring surface 14 which is attached to the upper subfloor 15 by means of a flooring fastener 33. The upper subfloor 15 is attached to the softwood runner 16 by means of subfloor staples 46.

Figure 9:
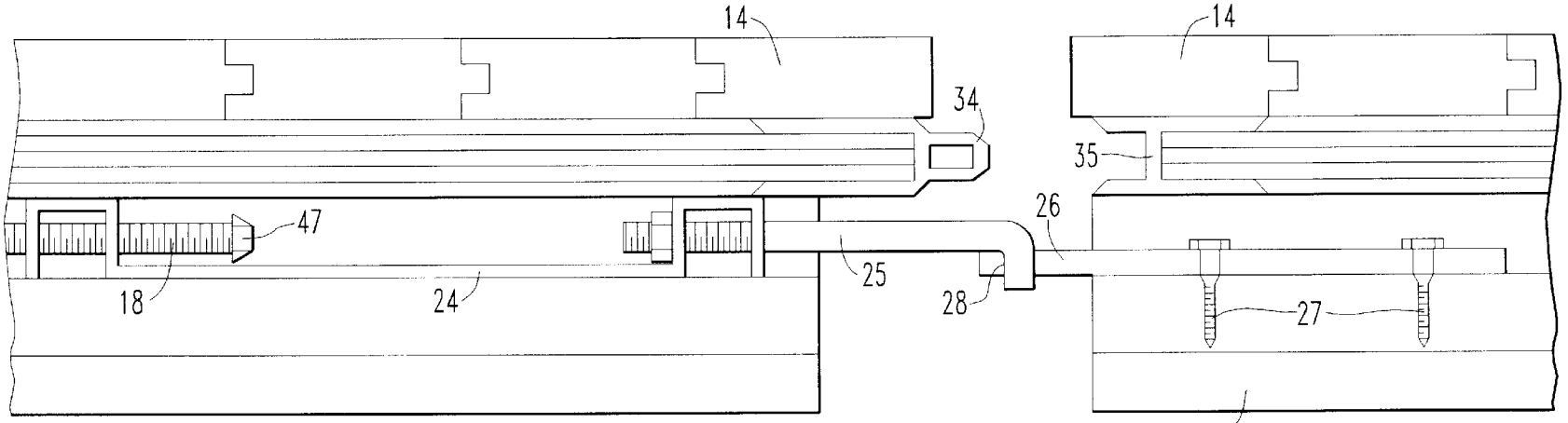
FIG. 9 is a side view of initial side panel alignment prior to engaging the drive mechanism and also depicts side panel alignment after mechanical release.

FIG. 9 details the panel-to-panel side alignment prior to mechanical connection as well as after mechanical disconnection. The panel side edge male connector 25 is interlocked with the opposing panel side edge female connector 26. The anchorage of the female connector 26 to the softwood runner 16 is provided by means of the wood lag bolts 27. The anchoring hole 28 provided in the female connector 26 is tapered in a manner to provide ease of alignment when the male connector 25 of the opposing panel is placed. The position of the panels as detailed in FIG. 9 shows the traveling mechanism 24 in the forward extended position and limited threaded rod 18 protruding through the traveling mechanism 24. A cap 47 is attached to the end of threaded rod 18 to prevent disassembly of the threaded rod 18 from the traveling mechanism 24. The flooring surface 14 extends beyond the upper subfloor side edge tongue 34 and groove 35.

Figure 10:
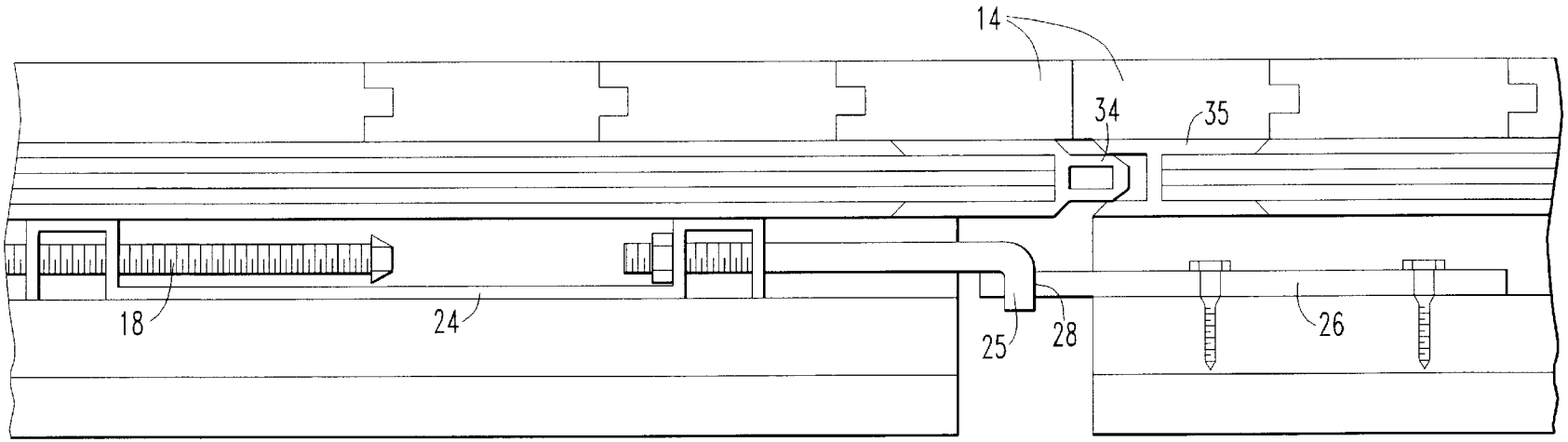
FIG. 10 is a side view of interlocked side panel alignment affected by the drive mechanism.

FIG. 10 details the opposing panel side edges in an interlocked position. The traveling mechanism 24 is detailed after moving into the reversed position as a result of clockwise movement of the threaded rod 18. The flooring surface 14 of the opposing panels are shown in position during assembly. Also detailed are the panel side edge tongue 34 and groove 35 assemblies which are interlocked below the flooring surface 14. Disassembly of the panels is facilitated by movement of the threaded rod 18 in the counterclockwise direction thereby forwarding the traveling mechanism 24. In turn the male connector 25 pushes against the side edge of the anchorage hole 28 of the female connector 26 forcing the opposing panels to separate as detailed in FIG. 9.

Figure 11A:
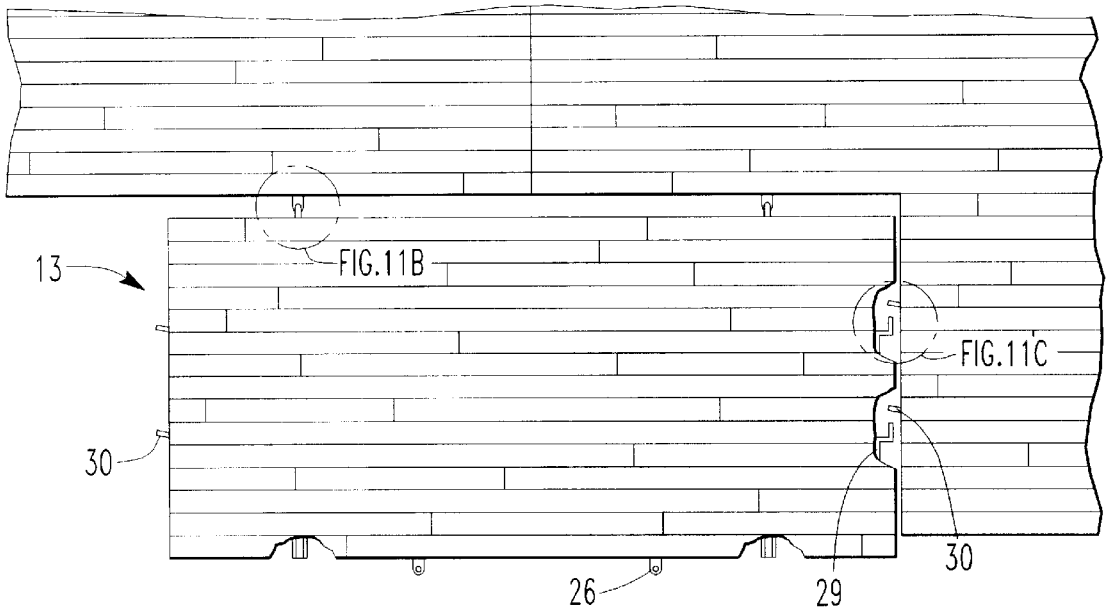
FIG. 11 is a top view including open views of panel alignment prior to activating the drive mechanism as well as post alignment after activating mechanical release.
Figure 11B:
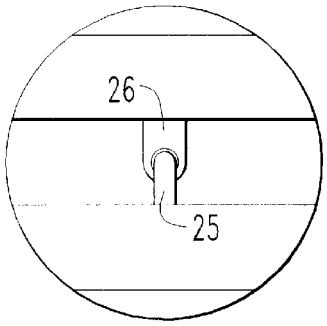
Figure 11C:
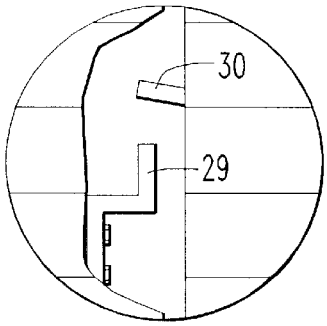

FIG. 11 is a top view detailing alignment of a portable panel 13 prior to interlocking mechanically to adjacent panels. Exposed views show the panel male side edge connectors 25 in position with the opposing panel female side edge connectors 26. Also detailed are panel end edge male connectors 29 in position to interlock with the opposed panel end edge female connectors 30. This detail illustrates the preference to angle the female connectors 30 slightly in relation to the opposing male connectors 29 to facilitate a movement of the panel 13 both toward the side and end edge as the panel 13 is mechanically interlocked.

Figure 12B:
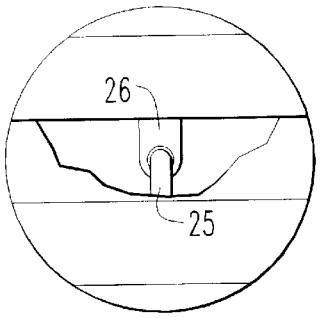
FIG. 12 is a top view of a typical portable panel connection providing open view of both the side panel and end panel attachment.
Figure 12C:
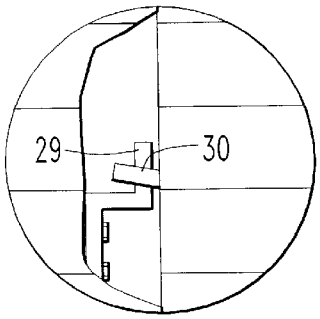
Figure 12A:
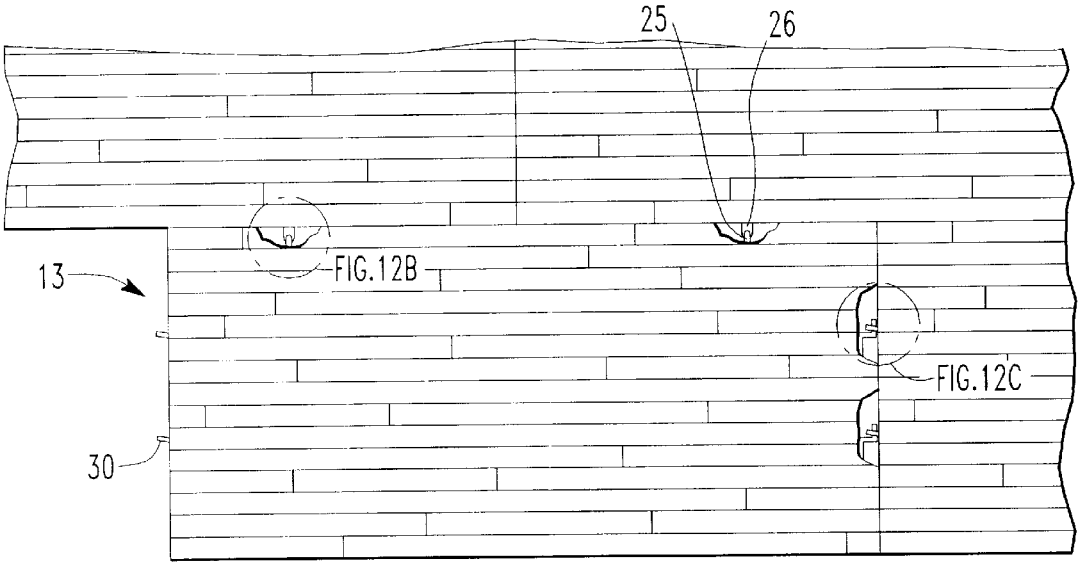

FIG. 12 details the connectors as the panel 13 is in the interlocked position. The panel side edge male connectors 25 are detailed in the reverse position aligning the opposing panel side edge female connectors 26 below the edge of the panel 13. The panel end edge male connectors 29 and opposing female connectors 30 are interlocked as the panel 13 is mechanically moved into position.

Figure 13:
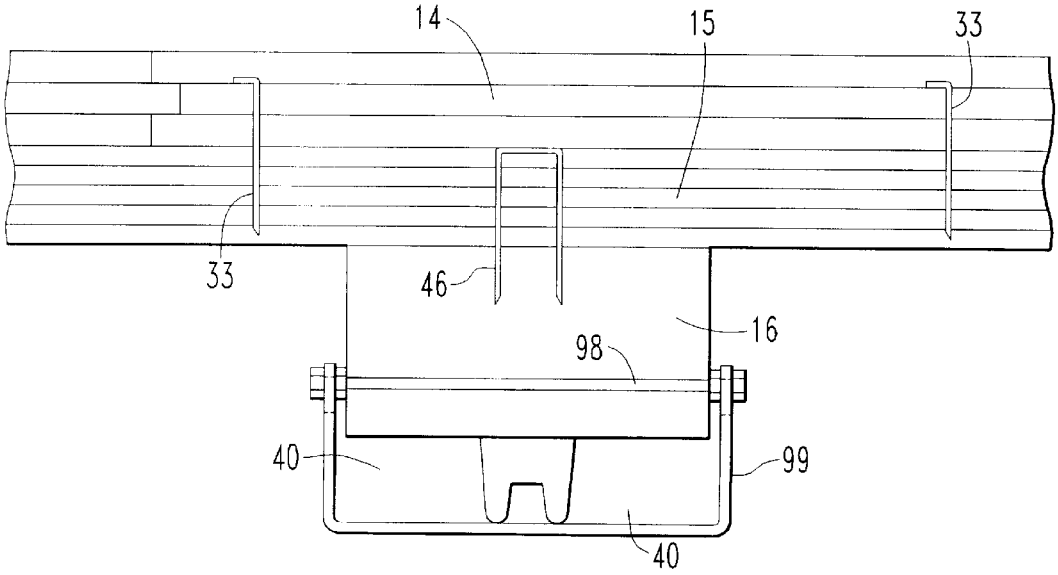
FIG. 13 is an alternative end view of resilient pads and resilient pad encasement.

FIG. 13 illustrates an alternative embodiment of an encasement for the resilient pad within the contemplation of this invention, similar to FIG. 8. The encasement 99 is affixed by penetrating softwood runner 16 with bolt 98.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A portable panel floor system comprised of:

(a) a plurality of floor panels, each floor panel including a top surface, a bottom surface, opposed side surfaces and opposed end surfaces;

(b) a first interlock mechanism on a side surface of a main floor panel, the first interlock mechanism disposed to interlock with a first corresponding interlock mechanism on a first adjacent panel;

(c) a second interlock mechanism on an end surface of the main floor panel, the second interlock mechanism disposed to interlock with a second corresponding interlock mechanism on a second adjacent panel; and (d) a drive mechanism operatively attached to the second interlock mechanism, the drive mechanism including a rotatable threaded rod disposed relative to the second interlock mechanism such that when the threaded rod is rotated, the second interlock mechanism is moved relative to the main floor panel.

2. A portable panel floor system as recited in claim 1, wherein the second interlock mechanism on the end surface is disposed relative to the second corresponding interlock mechanism on the second adjacent panel such that the second adjacent panel moves relative to the main floor panel adjacent the end surface when the threaded rod is rotated.

3. A portable panel floor system comprised of:

(a) a plurality of floor panels, each floor panel including a top surface, a bottom surface, opposed side surfaces and opposed end surfaces; and (b) a first interlock mechanism on a side surface of a main floor panel, the first interlock mechanism disposed to interlock with a first corresponding interlock mechanism on a first adjacent panel such that when the first interlock mechanism engages the first corresponding interlock mechanism, and the main floor panel and first adjacent panel are moved in opposed vertical relation to each other, the main floor panel and the first adjacent panel are moved in horizontal relation to each other.

4. A portable panel floor system as recited in claim 3, wherein the portable panel floor system includes a second interlock mechanism on an end surface of the main floor panel, the second interlock mechanism disposed to interlock with a second corresponding interlock mechanism on a second adjacent panel.

5. A portable panel floor system as recited in claim 4, wherein the portable panel floor system includes a drive mechanism operatively attached to the second interlock mechanism, the drive mechanism including a rotatable threaded rod disposed relative to the second interlock mechanism such that when the threaded rod is rotated, the second interlock mechanism is moved relative to the main floor panel.

6. A portable panel floor system comprised of:

(a) a plurality of floor panels, each floor panel including a top surface, a bottom surface, opposed side surfaces and opposed end surfaces;

(b) a second interlock mechanism on an end surface of a main floor panel, the second interlock mechanism disposed to interlock with a second corresponding interlock mechanism on a second adjacent panel;

(c) a drive mechanism operatively attached to the second interlock mechanism, the drive mechanism including a rotatable threaded rod disposed relative to the second interlock mechanism such that when the threaded rod is rotated, the second interlock mechanism is moved relative to the main floor panel wherein the portable panel floor system includes a first interlock mechanism on a side surface of the main floor panel, the first interlock mechanism disposed to interlock with a first corresponding interlock mechanism on a first adjacent panel such that when the first interlock mechanism engages the first corresponding interlock mechanism and the main floor panel and first adjacent panel are moved into opposed vertical relation to each other, the main floor panel and the first adjacent panel are moved in horizontal relation to each other.

7. A drive mechanism system for moving a first floor panel relative to a second floor panel where each floor panel includes a top surface, a bottom surface, opposed side surfaces and opposed end surfaces comprised of:

(a) a threaded rod having a first end and a second end, where the first end of the threaded rod is rotatably mounted to the first floor panel and the second end of the threaded rod is rotatably connected to a traveling mechanism;

(b) the traveling mechanism having a first end and a second end, where the first end of the traveling mechanism has an aperture for rotatably receiving the second end of the threaded rod, and where the second end of the traveling mechanism has an aperture for fixedly receiving an interlocking mechanism; and (c) the interlocking mechanism having a first end and a second end, where said first end of the interlocking mechanism is fixedly received by the aperture on the second end of the traveling member and where the second end of the interlocking mechanism is disposed to interlock with an opposing interlocking mechanism mounted on the second floor panel.

8. A portable panel floor system, including a plurality of floor panels, each floor panel including a top surface, a bottom surface, opposed side surfaces and opposed end surfaces, comprised of:

(a) a first interlock mechanism on a side surface of a main floor panel, the first interlock mechanism disposed to interlock with a first corresponding interlock mechanism on a first adjacent panel, a second interlock mechanism on an end surface of the main floor panel, the second interlock mechanism disposed to interlock with a second corresponding interlock mechanism on a second adjacent panel; and (b) a drive mechanism operatively attached to the second interlock mechanism, the drive mechanism including a rotatable threaded rod and disposed relative to the second interlock mechanism such that when the threaded rod is rotated, the second interlock mechanism is moved relative to the main floor panel.

9. A process for the assembly of a portable panel floor system, comprised of the following steps:

(a) providing a plurality of floor panels, each floor panel including a top surface, a bottom surface, opposed side surfaces and opposed end surfaces;

(b) providing a first interlock mechanism on a side surface of a main floor panel and a second interlock mechanism on an end surface of the main floor panel, the first interlock mechanism disposed to interlock respectively with a first corresponding interlock mechanism on a side surface of a first adjacent panel and the second interlock mechanism disposed to interlock respectively with a second corresponding interlock mechanism on an end surface of a second adjacent panel;

(c) providing a drive mechanism operatively attached to the second interlock mechanism, the drive mechanism including a rotatable threaded rod and disposed relative to the second interlock mechanism such that when the threaded rod is rotated, the second interlock mechanism is moved relative to the main floor panel;

(d) interlocking the first interlock mechanism with the first corresponding interlock mechanism on the side surface of the first adjacent panel;

(e) interlocking the second interlock mechanism with a second corresponding interlock mechanism on the end surface of the second adjacent panel; and (f) rotating the threaded rod, thereby moving the main floor panel toward the first adjacent panel and concurrently moving the main floor panel toward the end surface of the second adjacent panel.

10. A process for assembly of a portable panel floor system, comprised of the following steps:

(a) providing a plurality of floor panels, each floor panel including a top surface, a bottom surface, opposed side surfaces and opposed end surfaces;

(b) providing a first interlock mechanism on a side surface of a main floor panel and a second interlock mechanism on an end surface of the main floor panel, the first interlock mechanism disposed to interlock with a first corresponding interlock mechanism on a first adjacent panel and the second interlock mechanism disposed to interlock with a second corresponding interlock mechanism on a second adjacent panel;

(c) providing a drive mechanism operatively attached to the second interlock mechanism, the drive mechanism including a rotatable threaded rod and disposed relative to the second interlock mechanism such that when the threaded rod is rotated, the second interlock mechanism is moved relative to the main floor panel;

(d) interlocking the second interlock mechanism with the second corresponding interlock mechanism on the second adjacent panel; and (e) rotating the threaded rod, thereby moving the main floor panel relative to the second adjacent panel.

* * * * *